US010052893B2

(12) United States Patent
Ehara

(10) Patent No.: US 10,052,893 B2
(45) Date of Patent: Aug. 21, 2018

(54) PRINTING UNIT AND PRINTER

(71) Applicant: SEIKO SOLUTIONS INC., Chiba-shi, Chiba (JP)

(72) Inventor: Koji Ehara, Matsudo (JP)

(73) Assignee: SEIKO SOLUTIONS INC., Chiba (JP)

( * ) Notice: Subject to any disclaimer, the term of this patent is extended or adjusted under 35 U.S.C. 154(b) by 0 days.

(21) Appl. No.: 15/592,577

(22) Filed: May 11, 2017

(65) Prior Publication Data

US 2017/0368854 A1 Dec. 28, 2017

(30) Foreign Application Priority Data

Jun. 22, 2016 (JP) ..... 2016-123921

(51) Int. Cl.
*B41J 25/00* (2006.01)
*B41J 19/00* (2006.01)

(52) U.S. Cl.
CPC ..... *B41J 25/006* (2013.01)

(58) Field of Classification Search
CPC .... B41J 2025/008; B41J 19/14; B41J 19/142; B41J 19/145; B41J 19/76; B41J 19/78; B41J 19/96; B41J 19/00; B41J 19/20; B41J 19/34; B41J 19/51; B41J 19/60; B41J 19/202; B41J 19/205; B41J 19/207; B41J 11/22; B41J 25/005; B41J 25/001; B41J 25/003; B41J 25/006
See application file for complete search history.

(56) References Cited

U.S. PATENT DOCUMENTS 5,598,192 A * 1/1997 Burger ..... B41J 25/001 347/40
6,579,019 B2 * 6/2003 Ansell ..... B41J 19/14 101/71
6,695,497 B2 * 2/2004 Ford ..... B41J 19/14 400/139
2001/0038765 A1 * 11/2001 Ansell ..... B41J 19/14 400/283
2001/0053302 A1 * 12/2001 Ansell ..... B41J 19/14 400/175

(Continued)

FOREIGN PATENT DOCUMENTS

JP 07-214832 A 8/1995

*Primary Examiner* — Patrick King
(74) *Attorney, Agent, or Firm* — Brinks Gilson & Lione

(57) ABSTRACT

A printing unit includes: a line feed plate moving with a carriage in a line feed operation area; and guide members provided on a unit frame, engaging with the line feed plate, and guiding the carriage and the line feed plate toward one side in a left-right direction as the carriage and the line feed plate move toward one side in a front-back direction in the line feed operation area. Each guide member includes: a line feed guide extending toward one side in the left-right direction as it goes toward one side in the front-back direction and guiding the carriage toward one side in the left-right direction as the carriage moves toward one side in the front-back direction in the line feed operation area; and regulating sections continuing at least to one end in the front-back direction of the line feed guide and regulating the movement of the carriage in the left-right direction.

10 Claims, 14 Drawing Sheets

(56) References Cited

U.S. PATENT DOCUMENTS

| | | | | |
|---|---|---|---|---|
| 2002/0001496 | A1* | 1/2002 | Ford | B41J 19/14 400/76 |
| 2010/0177333 | A1* | 7/2010 | Nakagaki | B41J 11/008 358/1.12 |
| 2012/0306967 | A1* | 12/2012 | Shimizu | B41J 25/001 347/39 |
| 2013/0215198 | A1* | 8/2013 | Izawa | B41J 23/025 347/40 |
| 2013/0257983 | A1* | 10/2013 | Iesaki | B41J 25/001 347/37 |
| 2013/0293634 | A1* | 11/2013 | Shiota | B41J 25/34 347/37 |
| 2014/0347413 | A1* | 11/2014 | Ehara | B41J 19/202 347/8 |

* cited by examiner

PRINTING UNIT AND PRINTER

RELATED APPLICATIONS

This application claims priority under 35 U.S.C. § 119 to Japanese Patent Application No. 2016-123921 filed on Jun. 22, 2016, the entire content of which is hereby incorporated by reference.

BACKGROUND OF THE INVENTION

1. Technical Field

The present invention relates to a printing unit and a printer.

2. Related Art

A printer of a dot impact type is known as a printer used for timestamps or the like, for example. The printer of this type includes a carriage that reciprocates in a row direction, a printing head mounted on the carriage, and a cartridge mounted on the carriage and having an ink ribbon housed therein (see, for example, Japanese Patent No. 2791350).

With this configuration, the printer performs printing on a recording medium by hitting head pins of the printing head against the recording medium via the ink ribbon in a process in which the carriage reciprocates in the row direction on the recording medium.

Meanwhile, a configuration has been considered recently in which the carriage is moved through different positions in a column direction orthogonal to the row direction, between the forward path and the backward path, thus performing printing with the printing head both on the forward path and on the backward path. With this configuration, printing can be performed in printing areas in two different columns in the column direction on the recording medium. Therefore, the volume of information that can be printed at a time on the recording medium can be increased and marketability is expected to be improved.

However, in the foregoing printer, if an external force acts in the column direction on the carriage, the carriage may unexpectedly move in the column direction. In such a case, inconveniences occur such as an overlap between forward-path information printed on the forward path and backward-path information printed on the backward path, or forward-path information and backward-path information being too distant from each other in the column direction.

SUMMARY OF THE INVENTION

An advantage of some aspects of the invention is that a printing unit and a printer which are capable of restraining unexpected movement of a carriage in a column direction and thus improving marketability are provided.

According to an aspect of the invention, a printing unit includes: a carriage equipped with a printing head which performs printing on a recording medium in a printing operation area extending in a row direction; a shaft which supports the carriage in such a way that the carriage can reciprocate in the row direction; a unit frame which supports the shaft in such a way that the shaft can move in a column direction orthogonal to the row direction; an interlocking member which moves with the carriage in a line feed operation area situated outside the printing operation area in the row direction; and a guide member which is provided on the unit frame, engages with the interlocking member and guides the carriage and the interlocking member toward one side in the column direction with movement of the carriage and the interlocking member toward one side in the row direction in the line feed operation area. A first member being one of the interlocking member and the guide member includes a line feed guide which extends toward one side in the column direction as it goes toward one side in the row direction and which guides the carriage toward one side in the column direction with the movement of the carriage toward one side in the row direction, and a regulating section which continues at least to one end part in the row direction of the line feed guide and regulates the movement of the carriage in the column direction.

With this configuration, in the line feed operation area, the carriage is guided by the guide member and thus moves toward one side in the column direction as the carriage moves with the interlocking member toward one side in the row direction. Therefore, the carriage moves through different positions in the column direction in the printing operation areas on the forward path and the backward path. In this case, printing can be performed in different printing areas in the column direction on the recording medium, for example, by printing with the printing head both on the forward path and on the backward path. Consequently, the volume of information that can be printed at a time can be increased and marketability can be improved.

Particularly, this configuration includes the regulating section, which continues to the one end part in the row direction in the line feed guide and regulates the movement of the carriage in the column direction.

With this configuration, even if an external force acts in the column direction on the carriage when a second member of the interlocking member and the guide member is situated at the regulating section, the movement of the carriage in the column direction relative to the guide member is regulated. Therefore, the carriage can be restrained from moving unexpectedly in the column direction. In this case, inconveniences such as an overlap between forward-path information (information printed in the first row) and backward-path information (information printed in the second row), or forward-path information and backward-path information being too distant from each other in the column direction, can be restrained. Therefore, the marketability of the printing unit can be improved.

Moreover, with this configuration, the movement of the interlocking member in the column direction can be regulated at a position that does not enter the moving trajectory of the interlocking member at the time of line feed. Therefore, the load applied to a driving source which drives the carriage can be reduced, for example, compared with the case where a protrusion or the like which the interlocking member can climb over is provided on the moving trajectory of the interlocking member at the time of line feed. Thus, an increase in the size of the driving source can be restrained and energy saving can be realized.

In the printing unit, the regulating section may continue to both end parts in the row direction of the line feed guide.

With this configuration, since the regulating section continues to both the end parts in the row direction of the line feed guide, the carriage can be restrained from moving unexpectedly in the column direction in the printing operation areas both on the forward path and on the backward path. Thus, the marketability of the printing unit can be improved further.

In the printing unit, the regulating section may linearly extend along the row direction.

With this configuration, since the regulating section extends linearly in the row direction, the amount of movement of the carriage in the column direction can be minimized in the case where the carriage is to move unexpectedly in the column direction due to an external force.

In the printing unit, an engaging protruding section protruding toward the first member may be formed on a second member being the other of the interlocking member and the guide member. An engaging recessed section which engages with the engaging protruding section may be formed on the first member. The engaging recessed section may have the line feed guide and the regulating section.

With this configuration, since the line feed guide and the regulating section are formed in the engaging recessed section, the engaging protruding section may be smoothly guided at the time of line feed. Also, since the engaging protruding section is surrounded from both sides in the column direction, the movement of the interlocking member toward both sides in the column direction relative to the guide member can be regulated when an external force acts on the carriage.

In the printing unit, the interlocking member may be supported by the shaft in such a way as to be able to move in the row direction. The interlocking member may include a forward-path engaging section with which the carriage engages in a forward-path line feed area continuing to one side of the printing operation area, of the line feed operation area, and a backward-path engaging section with which the carriage engages in a backward-path line feed area continuing to the other side of the printing operation area, of the line feed operation area.

With this configuration, since the carriage engages with the forward-path engaging section of the interlocking member in the forward-path line feed area, the carriage is to move with the interlocking member toward one side in the column direction when subsequently heading toward a forward-path end point. Also, since the carriage engages with the backward-path engaging section of the interlocking member in the backward-path line feed area, the carriage is to move with the interlocking member toward the other side in the column direction when subsequently heading toward a backward-path end point. Thus, the carriage can be smoothly moved for line feed in the line feed operation area.

In the printing unit, a step section which the first member can climb over may be formed in at least one of the line feed guide and the regulating section.

With this configuration, when an external force unexpectedly acts on the carriage, the second member of the interlocking member and the guide member is caught at the step section and therefore the second member can be restrained from moving in the column direction abruptly. At the time of moving the carriage for line feed, as the carriage moves with the interlocking member, the second member climbs over the step section.

The printing unit may further include: a driving source which moves the carriage in the row direction; a printing frame equipped with the driving source and supporting the shaft; and a bearing section which is provided in the unit frame, supports the shaft in such a way that the shaft can reciprocate in the column direction, and is coupled to the printing frame to regulate a swing of the printing frame around the shaft.

With this configuration, the bearing section regulates swings of the printing frame around the shaft while supporting the shaft in such a way that the shaft can move in the column direction. Therefore, a reduction in the number of components, a reduction in cost and improvement in assemblability can be achieved, compared with the case where the respective functions are performed by separate components.

In the printing unit, the printing head may be an impact type. The printing unit may include a winding mechanism which is connected to a cartridge removably loaded in the carriage and winds an ink ribbon in the cartridge. The winding mechanism may include a winding gear arranged in the carriage, and a rack plate including a winding rack which meshes with the winding gear. The winding mechanism may wind the ink ribbon, having the winding gear rotate as the carriage moves in the row direction.

With this configuration, the ink ribbon is wound up as the carriage moves. Therefore, the occurrence of changes in print density, print blurs and the like can be restrained, and good printing quality can be maintained.

In the printing unit, the rack plate may include toothless areas for releasing the meshing of the winding gear with the winding rack at both end parts in the row direction.

With this configuration, the toothless areas for releasing the meshing of the winding gear with the winding rack are formed. Therefore, at the time of line feed of the carriage, when the carriage passes both end parts in the row direction of the rack plate, the winding gear does not rotate with the movement of the carriage. That is, while the carriage moves through the toothless areas, the ink ribbon is not wound up. Therefore, the load torque required for the winding at the time of line feed is restrained from acting on the driving source, and the line feed operation can be performed smoothly. Also, since the unwanted winding of the ink ribbon can be restrained at the time of line feed, the ink ribbon can be effectively used.

According to another aspect of the invention, a printer includes: the printing unit according to the foregoing aspect; and a casing which houses the printing unit and has a slot into which a recording medium is inserted.

With this configuration, the printer includes the printing unit according to the foregoing configuration. Therefore, the marketability of the printer can be improved.

According to the foregoing aspects of the invention, a printing unit and a printer that can restrain unexpected movement of the carriage in the column direction and can improve marketability can be provided.

DETAILED DESCRIPTION OF THE INVENTION

Embodiments of the invention will now be described with reference to the drawings.

First Embodiment

Printer

Figure 1:
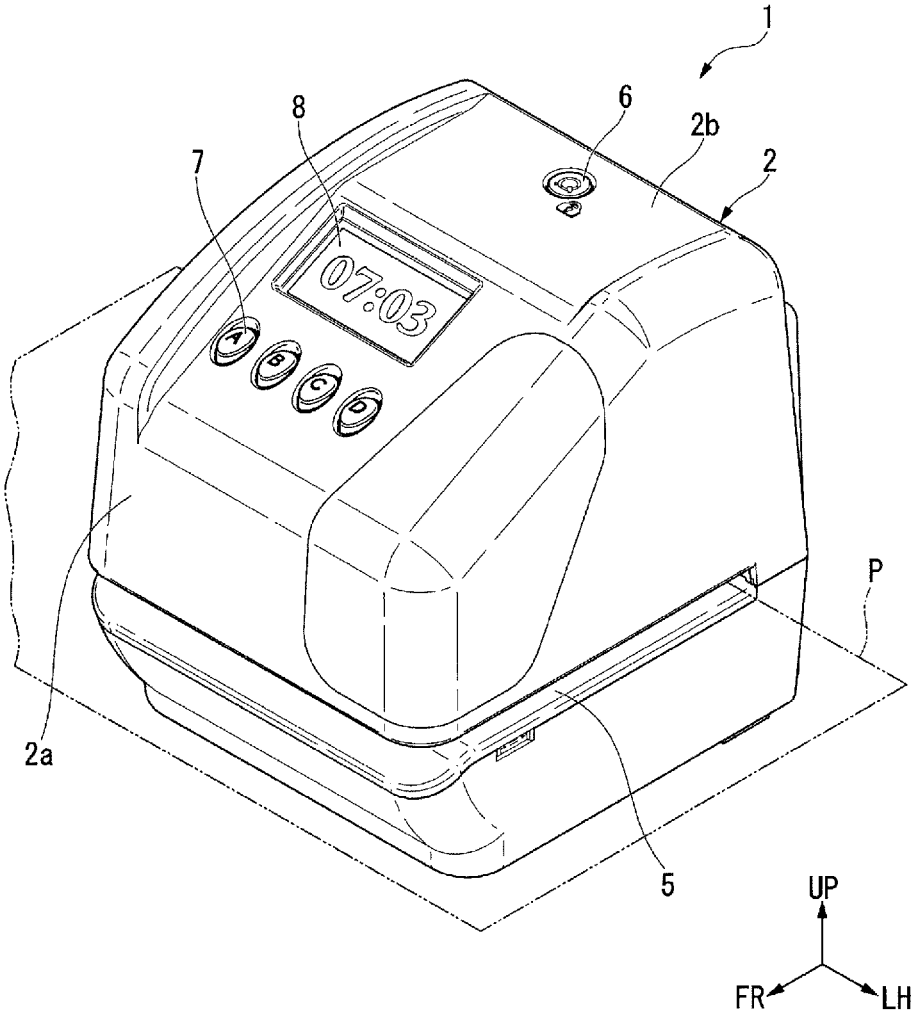
FIG. 1 is a perspective view of a printer according to a first embodiment as viewed from the left.

FIG. 1 is an exterior perspective view of a printer 1 as viewed from the left.

As shown in FIG. 1, the printer 1 in the embodiment is used for timestamps or the like. The printer 1 prints information about time such as a date and time of day in a printing area of card-like recording paper (recording medium) P. Specifically, the printer 1 includes a casing 2 and a printing unit 3 (see FIG. 2) housed in the casing 2. In the explanation below, the lower left side of the paper surface in FIG. 1 is referred to as forward (arrow FR direction). The upper right side is referred to as backward. The upper side is referred to as upward (arrow UP direction). The lower side is referred to as downward. In FIG. 1, the lower right side with respect to the paper surface is referred to as left side (arrow LH direction) when viewed from the printer 1, and the upper left side is referred to as right side when viewed from the printer 1.

The casing 2 is made of a resin material or the like. The casing 2 is formed in the shape of a rectangular parallelepiped. On a front wall 2*a* of the casing 2, a slot 5 recessed backward is formed in the center in the up-down direction. The recording paper P is removably inserted into the slot 5 from the forward end thereof. The slot 5 penetrates the casing 2 in the left-right direction. The thickness of the recording paper P can be changed as appropriate, provided that the recording paper P can be removably inserted into the slot 5.

On an upper wall 2*b* of the casing 2, a keyhole 6, operation buttons 7 to perform various operations, and a display section 8 which displays time of day and the like are arranged. In the example shown in FIG. 1, the front part of the upper wall 2*b* is tilted downward as it extends forward.

Printing Unit

Figure 2:
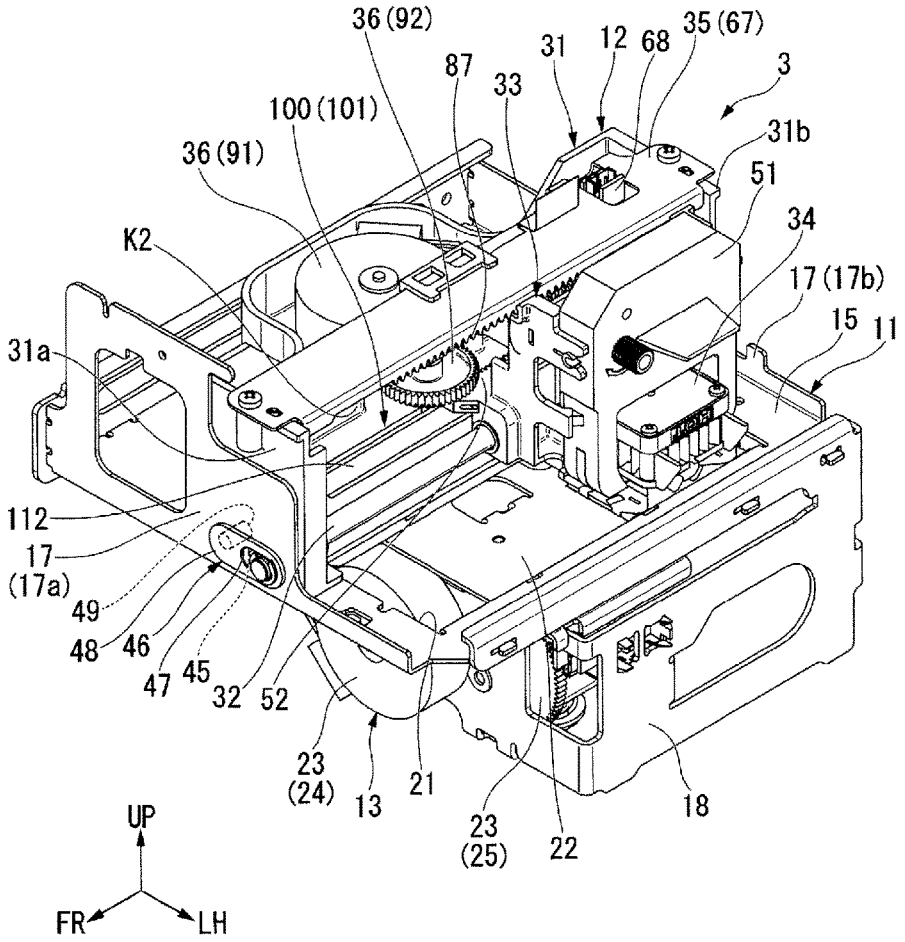
FIG. 2 is a perspective view of a printing unit according to the first embodiment as viewed from the left.

FIG. 2 is a perspective view of the printing unit 3 as viewed from the left.

Figure 3:
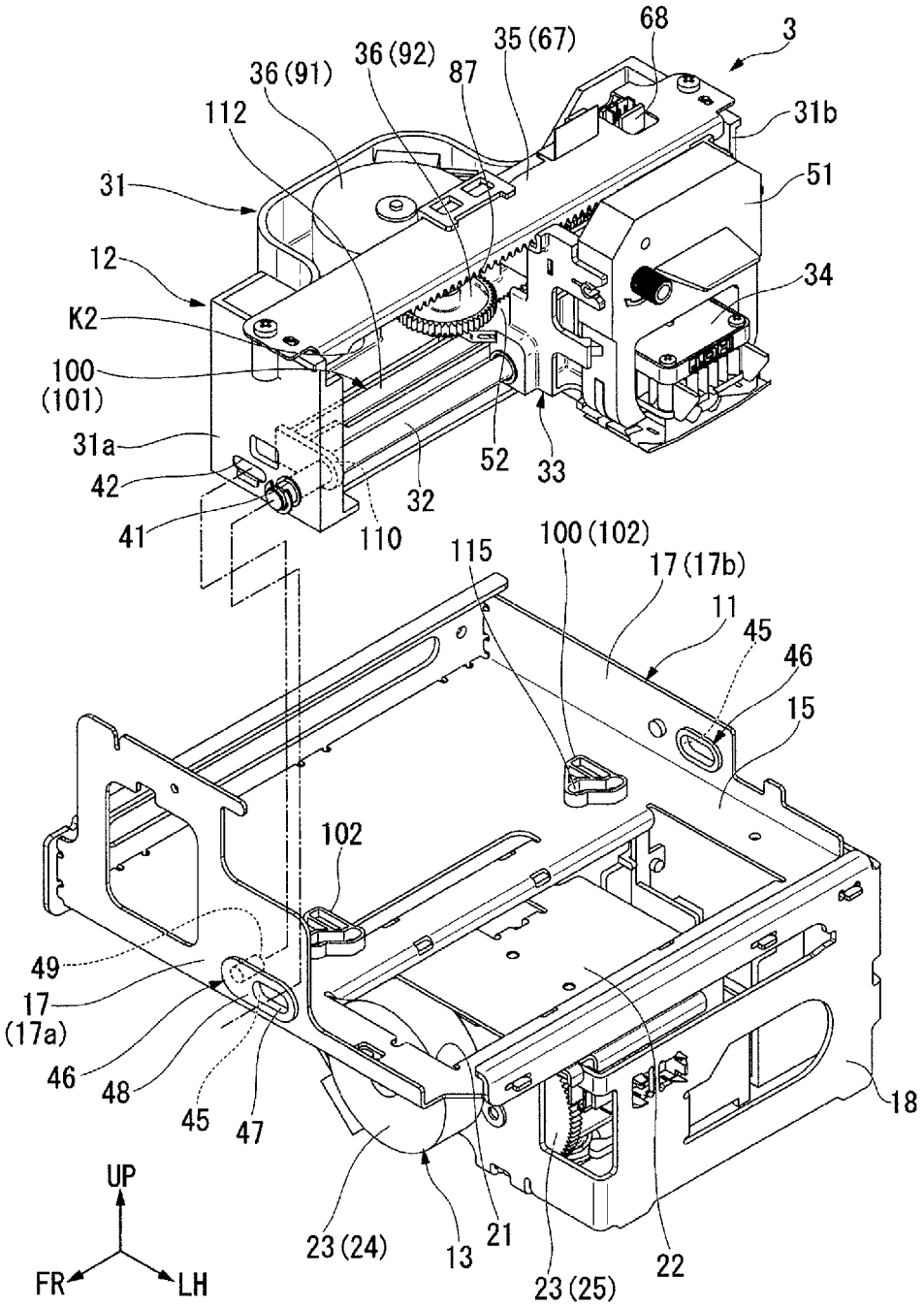
FIG. 3 is an exploded perspective view of the printing unit shown in FIG. 2.

FIG. 3 is an exploded perspective view of the printing unit 3 shown in FIG. 2.

As shown in FIGS. 2 and 3, the printing unit 3 mainly includes a unit frame 11, and a printing block 12 and a platen block 13 mounted on the unit frame 11.

The unit frame 11 is formed by bending metal or the like. Specifically, the unit frame 11 includes a frame base 15, printing block supporting sections 17 which support the printing block 12, and a platen supporting section 18 which supports the platen block 13.

The frame base 15 is formed in a rectangular shape as viewed in a plan view seen from above. At a left end part of the frame base 15, an opening for printing 21 penetrating the frame base 15 in the up-down direction is formed. A rubber stopper, not illustrated, is attached from below to an opening edge of the opening for printing 21 of the frame base 15. The frame base 15 is situated above the slot 5.

The printing block supporting sections 17 include supporting walls 17*a* and 17*b* erected upward from front and rear end parts of the frame base 15.

The platen supporting section 18 is situated below the frame base 15. The platen supporting section 18 is formed in a rectangular shape as viewed in a plan view seen from above. The platen supporting section 18 is situated below the slot 5. That is, the recording paper P inserted into the slot 5 enters the space between the frame base 15 and the platen supporting section 18 from the forward end side of the slot 5.

Platen Block

The platen block 13 includes a platen main body 22 and a platen driving mechanism 23 which drives the platen main body 22.

The platen main body 22 is formed in the shape of a plate as viewed in a plan view seen from above. The platen main body 22 is supported in such a way as to be able to move up and down by the platen supporting section 18. Specifically, the platen main body 22 moves up and down between a holding position where the platen main body 22 comes into contact with the frame base 15 from below and a retracting position where the platen main body 22 moves downward away from the frame base 15. At the holding position, the platen main body 22 comes into contact with the frame base 15 via the rubber stopper attached to the frame base 15. At the retracting position, the platen main body 22 retracts below the slot 5.

The platen driving mechanism 23 includes a platen motor 24 and a platen wheel train 25 or the like which connects the platen motor 24 with the platen main body 22.

Printing Block

The printing block 12 mainly includes a printing frame 31, a shaft 32, a carriage 33, a winding mechanism 35, and a driving mechanism for printing 36.

The printing frame 31 is formed in the shape of a box opening upward and leftward. As shown in FIG. 3, in lower parts of a front wall 31*a* and a rear wall 31*b* of the printing frame 31, through-holes 41 (in FIG. 3, only the through-hole 41 in the front wall 31*a* is shown) penetrating the front wall 31*a* and the rear wall 31*b*, respectively, in the front-back direction (row direction) are formed.

At parts situated to the right of the through-holes 41 in the front wall 31*a* and the rear wall 31*b*, regulating recessed sections 42 (in FIG. 3, only the regulating recessed section 42 in the front wall 31*a* is shown) recessed inward in the front-back direction are formed. Each of the regulating recessed sections 42 is formed in an elliptical shape having a longitudinal direction laid in the left-right direction (column direction) as viewed from a front view seen from the front-back direction.

The shaft 32 is formed in a columnar shape having its axial direction laid in the front-back direction. Front and rear end parts of the shaft 32 are individually supported in the through-holes 41 formed in the lower parts of the front wall 31*a* and the rear wall 31*b*. Of the front and rear parts of the shaft 32, portions situated on the outer side in the front-back direction from the front wall 31*a* and the rear wall 31*b* are supported by the supporting walls 17*a* and 17*b* of the printing block supporting sections 17. Specifically, in the supporting walls 17*a* and 17*b*, shaft supporting holes 45 penetrating the supporting walls 17*a* and 17*b* in the front-back direction are formed. The front and rear end parts of the shaft 32 are supported respectively in the shaft supporting holes 45 via bearing sections 46.

The shaft supporting holes 45 are elongated holes having their longitudinal direction laid in the left-right direction. Therefore, the shaft 32 is formed to be movable in the left-right direction within the shaft supporting holes 45.

Each of the bearing sections 46 includes a collar section 47 inserted in the shaft supporting hole 45, a flange section 48 protruding from an outer end part in the front-back direction of the collar section 47, and a protruding section 49 projecting inward in the front-back direction from the flange section 48.

The collar section 47 is formed in a cylindrical shape formed along the inner surface of the shaft supporting hole 45. The collar section 47 covers the inner surface of the shaft supporting hole 45. Therefore, the shaft 32 is supported in the shaft supporting hole 45 via the collar section 47.

The flange section 48 is formed in an elliptical shape having its longitudinal direction laid in the left-right direction as viewed in a plan view seen from the front-back direction. The collar section 47 is provided in a linked manner to a left end part of the flange section 48.

The protruding section 49 is arranged at a right end part of the flange section 48. The protruding sections 49 penetrate the supporting walls 17*a* and 17*b* of the printing block supporting sections 17 and project inward in the front-back direction from the supporting walls 17*a* and 17*b*. Inner end parts in the front-back direction of the protruding sections 49 are housed respectively in the regulating recessed sections 42. When the protruding sections 49 come into contact with the inner surfaces of the regulating recessed sections 42, the regulating recessed sections 42 regulate swings of the printing block 12 around the shaft 32.

The carriage 33 is formed in the shape of a rectangular parallelepiped. The shaft 32 penetrates a lower part of the carriage 33 in the front-back direction. Thus, the carriage 33 is supported by the shaft 32 in such a way as to be able to reciprocate in the front-back direction.

A cartridge 51 in which an ink ribbon, not illustrated, is housed is removably loaded in the carriage 33 from the left side.

A scanning rack 52 projecting to the right is formed in the carriage 33. The scanning rack 52 extends along the front-back direction.

Figure 4:
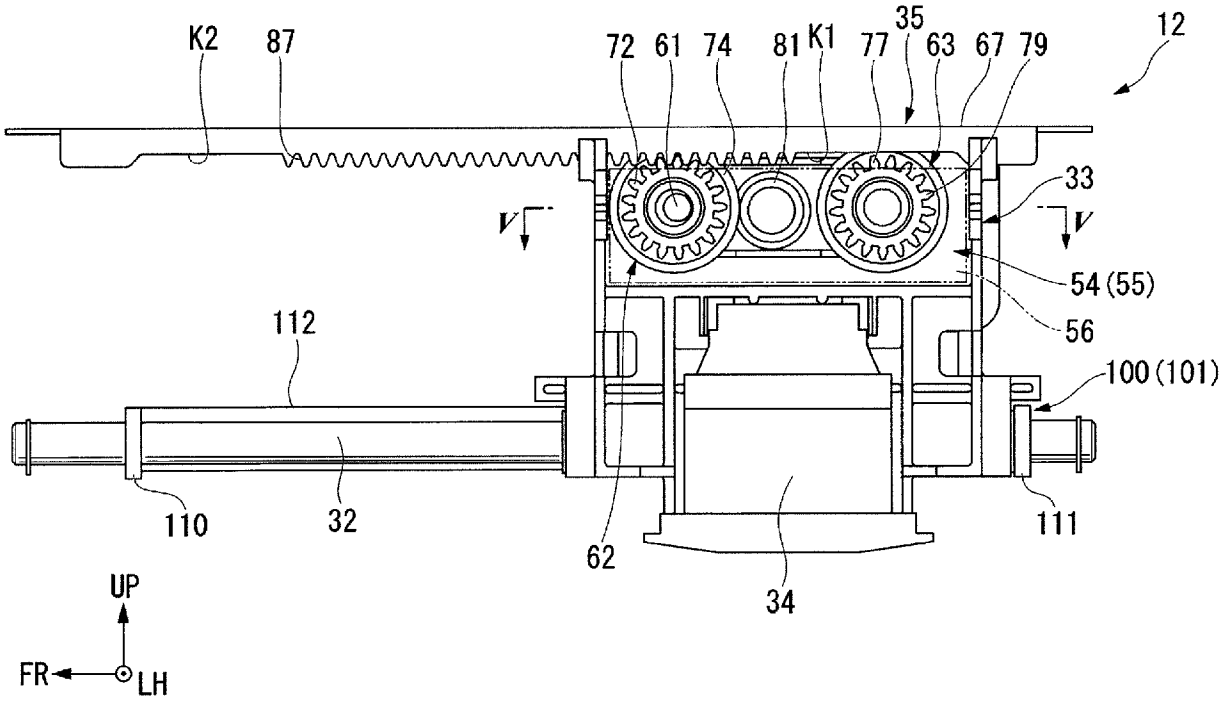
FIG. 4 is a side view of a printing block in the state where a cartridge is detached according to the first embodiment as viewed from the left.

FIG. 4 is a side view of the printing block 12 in the state where the cartridge 51 is detached, as viewed from the left.

As shown in FIG. 4, a wheel train housing section 54 is formed in an upper part of the carriage 33. The wheel train housing section 54 includes a housing recessed section 55 opening to the left, and a cover 56 which covers the housing recessed section 55 from the left.

As shown in FIGS. 2 and 3, the printing head 34 is attached to a lower part of the carriage 33 from the left side. The printing head 34 faces the opening for printing 21 in the frame base 15 from above. A plurality of head pins which can move up and down, not illustrated, is built in the printing head 34. The ink ribbon let out from the cartridge 51 can travel in the front-back direction below the printing head 34.

Figure 5:
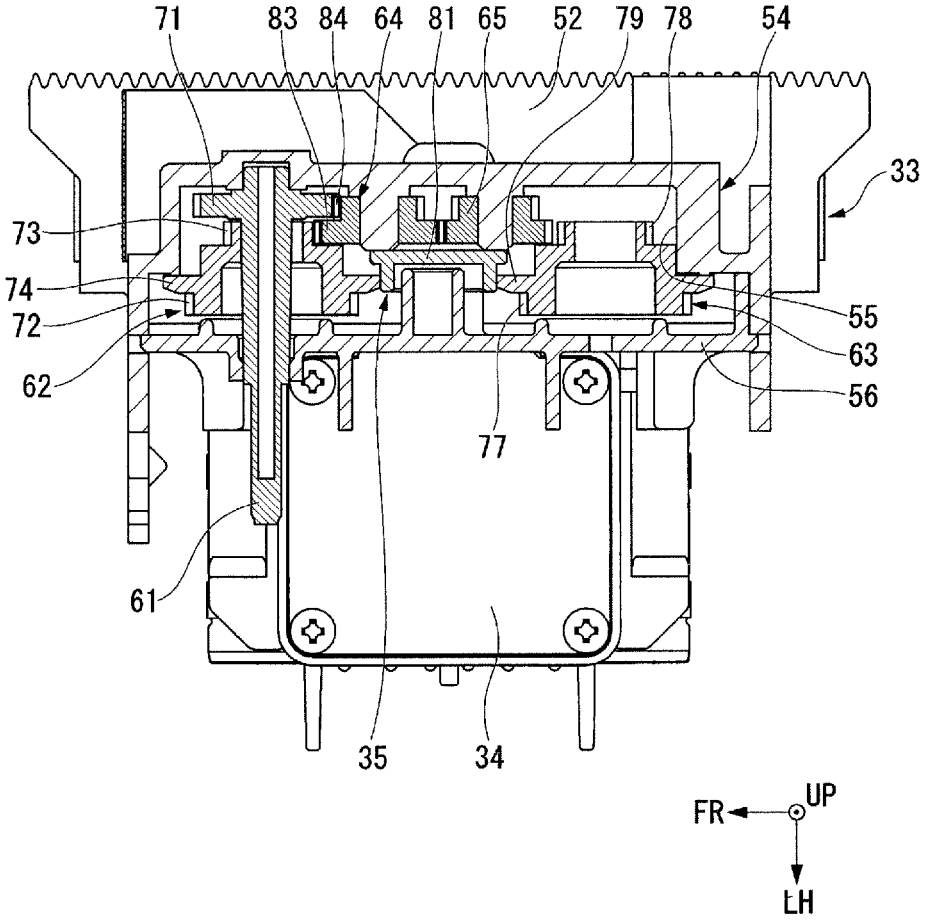
FIG. 5 is a cross-sectional view corresponding to a line V-V in FIG. 4.

FIG. 5 is a cross-sectional view corresponding to a line V-V in FIG. 4.

As shown in FIGS. 4 and 5, the winding mechanism 35 includes a winding wheel train 61-65 housed in the wheel train housing section 54, and a rack plate 67 arranged above the carriage 33.

The winding wheel train 61-65 includes a winding shaft 61, a first moving gear 62, a second moving gear 63, and an intermediate gear 64 and a reverse gear 65 which are arranged between the first moving gear (winding gear) 62 and the second moving gear (winding gear) 63.

The winding shaft 61 is arranged in a portion situated on the front side in the wheel train housing section 54. The winding shaft 61 is supported in the wheel train housing section 54 in such a way as to be rotatable around an axial line extending along the left-right direction. A left end part of the winding shaft 61 penetrates the cover 56 and projects outside of the wheel train housing section 54. The left end part of the winding shaft 61 is coupled to a bobbin, not illustrated, of the cartridge 51. A transmission gear 71 (see FIG. 5) protruding toward the outer circumference of the winding shaft 61 is formed at a right end part of the winding shaft 61.

The winding shaft 61 is inserted through the first moving gear 62 from the right side. The first moving gear 62 is supported in a portion situated to the left of the transmission gear 71, of the winding shaft 61, in such a way as to be rotatable around an axial line extending along the left-right direction and be movable in the front-back direction. As shown in FIG. 5, the first moving gear 62 includes a first large gear 72 situated on the left side, a first small gear 73 situated on the right side, and a first flange section 74 situated between the first large gear 72 and the first small gear 73 and larger in diameter than the first large gear 72. As shown in FIG. 4, upper end parts of the first large gear 72 and the first flange section 74 project upward from the wheel train housing section 54.

The second moving gear 63 is arranged further to the back than the first moving gear 62 in the wheel train housing section 54. The second moving gear 63 is supported in the wheel train housing section 54 in such a way as to be rotatable around an axial line extending along the left-right direction and be movable in the front-back direction. As shown in FIG. 5, the second moving gear 63 includes a second large gear 77 situated on the left side, a second small gear 78 situated on the right side, and a second flange section 79 situated between the second large gear 77 and the second small gear 78 and larger in diameter than the second large gear 77. The large gears 72 and 77, the small gears 73 and 78, and the flange sections 74 and 79 of the moving gears 62 and 63 are arranged respectively in equivalent positions in the left-right direction. As shown in FIG. 4, upper end parts of the second large gear 77 and the second flange section 79 project upward from the wheel train housing section 54.

In the wheel train housing section 54, a spacer 81 is arranged at a part situated between the moving gears 62 and 63. The spacer 81 is formed in the shape of a disk. The spacer 81 is supported in the wheel train housing section 54 in such a way as to be movable in the front-back direction.

The flange sections 74 and 79 of the moving gears 62 and 63 come into contact with the spacer 81 from the outer side in the front-back direction. Thus, a minimum inter-axis distance in the front-back direction between the moving gears 62 and 63 is maintained.

As shown in FIG. 5, the intermediate gear 64 is supported in such a way as to be rotatable around an axial line extending in the left-right direction at a part situated to the right of the spacer 81 in the wheel train housing section 54. The intermediate gear 64 includes an intermediate large gear 83 situated on the left side and an intermediate small gear 84 situated on the right side.

The meshing and releasing of the meshing of the intermediate large gear 83 with the first small gear 73 are switched as the first moving gear 62 moves in the front-back direction.

The intermediate small gear 84 is in mesh with the transmission gear 71 of the winding shaft 61.

The reverse gear 65 is arranged further to the back than the intermediate gear 64 in the wheel train housing section 54. The reverse gear 65 is formed in such a way as to be rotatable around an axial line extending in the left-right direction. The reverse gear 65 is in mesh with the intermediate large gear 83. The meshing and releasing of the meshing of the reverse gear 65 with the second small gear 78 are switched as the second moving gear 63 moves in the front-back direction.

As shown in FIGS. 3 and 4, the rack plate 67 bridges the gap between the upper end parts of the front wall 31*a* and the rear wall 31*b* of the printing frame 31. At least a part of the rack plate 67 is arranged at a position overlapping the carriage 33 as viewed in a plan view seen from the up-down direction. A winding rack 87 projecting downward extends in the front-back direction on the rack plate 67. As shown in FIG. 4, the winding rack 87 is formed in such a way as to be able to mesh with upper end parts (parts projecting from the wheel train housing section 54) of the large gears 72 and 77 of the moving gears 62 and 63 from above. The winding rack 87 is formed at a part avoiding both ends in the front-back direction of the rack plate 67. That is, both the ends in the front-back direction of the rack plate 67 are toothless areas K1 and K2 where the winding rack 87 is not provided. As shown in FIG. 3, a position sensor 68 which detects the position of the carriage 33 is mounted at a rear end part of the rack plate 67.

The driving mechanism for printing 36 includes a printing motor (driving source) 91 which is rotatable in normal and reverse directions, and a scanning gear 92 or the like which connects the printing motor 91 with the carriage 33.

The printing motor 91 is arranged at a part situated to the right of the carriage 33 in the printing frame 31.

The scanning gear 92 connects the printing motor 91 with the carriage 33 in the printing frame 31. The scanning gear 92 meshes with an output gear, not illustrated, which is connected to the output shaft of the printing motor 91, and also meshes with the scanning rack 52 of the carriage 33. The carriage 33 reciprocates in the front-back direction along the shaft 32 by having the driving force of the printing motor 91 transmitted thereto via the scanning gear 92 and the scanning rack 52.

Line Feed Mechanism

Here, the printing unit 3 in the embodiment includes a line feed mechanism 100 which moves the carriage 33 in the left-right direction. The line feed mechanism 100 includes a line feed plate (interlocking member, second member) 101 supported by the shaft 32 in such a way as to be movable in the front-back direction, and guide members (first member) 102 which guide the line feed plate 101 in the left-right direction as the line feed plate 101 moves in the front-back direction.

Figure 6:
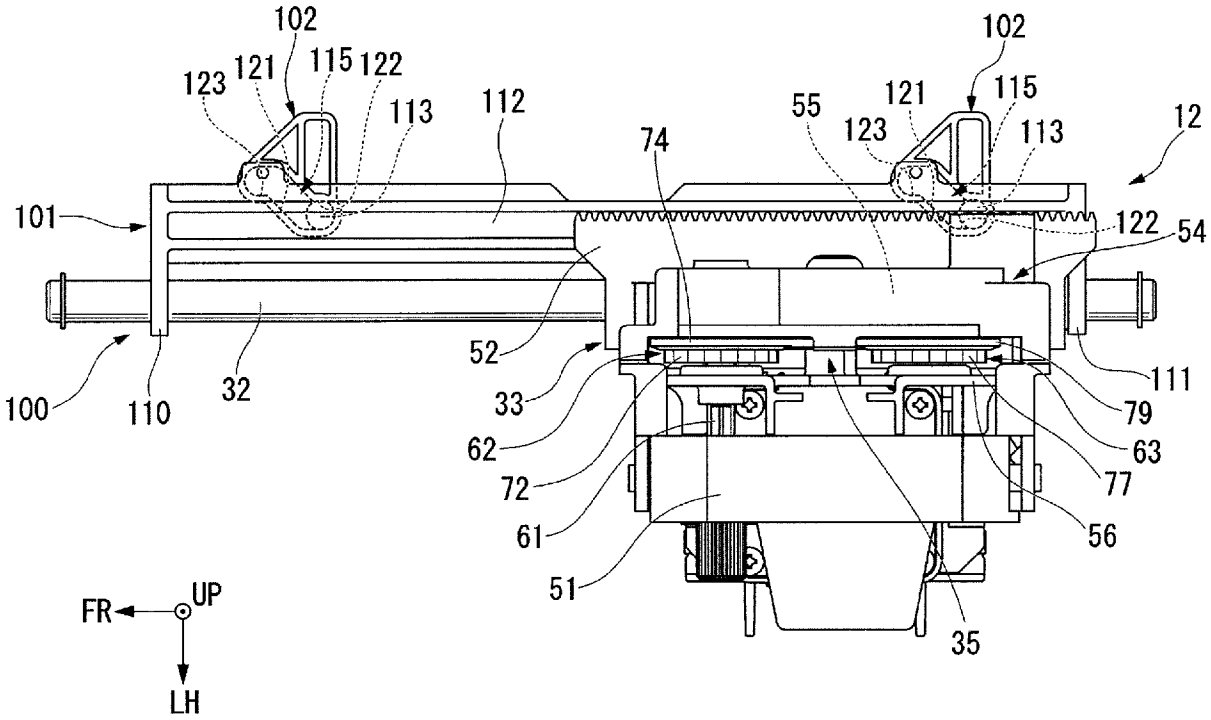
FIG. 6 is a plan view of a carriage and a line feed mechanism according to the first embodiment.

FIG. 6 is a plan view of the carriage 33 and the line feed mechanism 100.

As shown in FIG. 6, the line feed plate 101 is formed in a C-shape opening to the left as viewed in a plan view seen from the up-down direction. Specifically, the line feed plate 101 includes a forward-path engaging section 110 situated to the front of the carriage 33, a backward-path engaging section 111 situated behind the carriage 33, and a line feed base 112 bridging the gap between the engaging sections 110 and 111.

The shaft 32 penetrates a left end part of the forward-path engaging section 110. The forward-path engaging section 110 is opposite the carriage 33 in the front-back direction. Thus, the carriage 33 engages (comes into contact) with the forward-path engaging section 110 as the carriage 33 moves forward (on the forward path). The forward-path engaging section 110 is situated further to the front than the winding rack 87.

The shaft 32 penetrates a left end part of the backward-path engaging section 111. The backward-path engaging section 111 is opposite the carriage 33 in the front-back direction. Thus, the carriage 33 engages (comes into contact) with the backward-path engaging section 111 as the carriage 33 moves backward (on the backward path). The backward-path engaging section 111 is situated further to the back than the winding rack 87. In the example shown in FIG. 4, the distance between the inner end surfaces in the front-back direction of the engaging sections 110 and 111 is longer than the distance between the outer edges in the front-back direction of the toothless areas K1 and K2.

As shown in FIG. 6, the line feed base 112 is formed in the shape of a plate extending in parallel to the shaft 32 along the front-back direction. The line feed base 112 connects right end parts of the engaging sections 110 and 111. A pair of engaging protruding sections 113 projecting downward is formed at both ends in the front-back direction of the line feed base 112.

The guide members 102 are arranged respectively at positions overlapping the line feed plate 101 as viewed from the up-down direction, of both ends in the front-back direction of the frame base 15. In the guide members 102, engaging recessed sections 115 in which the engaging protruding sections 113 are housed respectively from above are formed.

Figure 7:
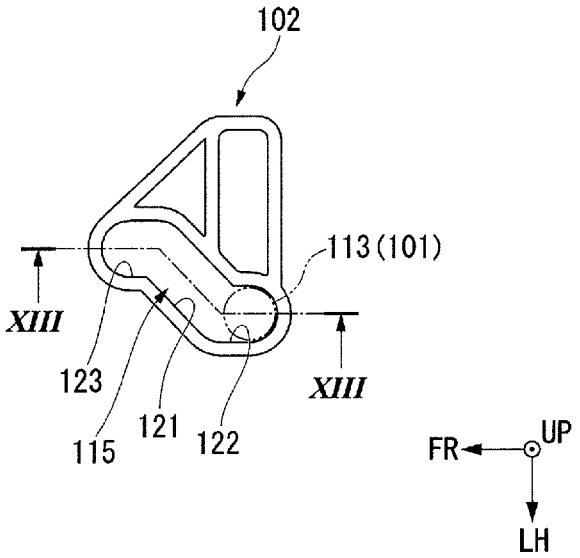
FIG. 7 is a plan view of a guide member according to the first embodiment.

FIG. 7 is a plan view of the guide member 102.

As shown in FIGS. 6 and 7, the engaging recessed section 115 includes a line feed guide 121, a forward-path regulating section 122, and a backward-path regulating section 123.

The line feed guide 121 is tilted toward the right (one side in the column direction) as it moves forward (one side in the row direction). The line feed guide 121 guides the engaging protruding section 113 in the left-right direction as the engaging protruding section 113 moves in the front-back direction. The tilt angle of the line feed guide 121 (angle formed by the extending direction of the line feed guide 121 and the front-back direction) and its dimensions or the like can be changed as appropriate.

The forward-path regulating section 122 continues to a rear end part of the line feed guide 121. The forward-path regulating section 122 linearly extends along the front-back direction. The engaging protruding section 113 can come into contact with the inner surface of the forward-path regulating section 122 in the left-right direction. Thus, the movement of the engaging protruding section 113 (line feed plate 101) in the left-right direction relative to the forward-path regulating section 122 (guide member 102) is regulated.

The backward-path regulating section 123 continues to a front end part of the line feed guide 121. The backward-path regulating section 123 linearly extends along the front-back direction. The engaging protruding section 113 can come into contact with the inner surface of the backward-path regulating section 123. Thus, the movement of the engaging protruding section 113 (line feed plate 101) in the left-right direction relative to the backward-path regulating section 123 (guide member 102) is regulated. The distance between a center part in the left-right direction of the forward-path regulating section 122 and a center part in the left-right direction of the backward-path regulating section 123 corresponds to a line feed width of the printing block 12.

Operation Method for Printer

Next, an operation method for the printer 1 will be described.

First, the recording paper P is inserted into the slot 5 from the front side, as shown in FIG. 1. The recording paper P, which has entered the slot 5, is arranged between the frame base 15 and the platen supporting section 18 shown in FIG. 2, in the casing 2. When the recording paper P reaches a predetermined position in the slot 5, the platen block 13 is actuated. Specifically, as the platen motor 24 is actuated, its driving force is transmitted to the platen main body 22 via the platen wheel train 25. Then, the platen main body 22 rises, causing the recording paper P to be held between the platen main body 22 and the frame base 15.

Subsequently, the printing block 12 is actuated. In the printer 1 in the embodiment, when reciprocating in the front-back direction, the carriage 33 passes through different positions in the left-right direction on the forward path and on the backward path. Then, by performing printing both on the forward path and on the backward path, the printer 1 can perform printing in two rows on the recording paper P.

Specifically, the printer 1 in the embodiment includes a forward-path printing step, a line feed step, a backward-path printing step, and a carriage return step.

In the forward-path printing step, the printer 1 performs printing of a first row in the printing area on the recording paper P in a process in which the carriage 33 moves forward from a forward-path start point (printing operation area).

In the line feed step, after the printing of the first row is performed on the recording paper P, the carriage 33 moves to the right (second row) while moving forward in a process of heading toward a forward-path end point (forward-path line feed area).

In the backward-path printing step, the printer 1 performs printing of the second row in the printing area on the recording paper P in a process in which the carriage 33 moves backward from a backward-path start point (forward-path end point) (printing operation area).

In the carriage return step, after the printing of the second row is performed on the recording paper P, the carriage 33 moves to the left while moving backward in a process of heading toward a backward-path end point (forward-path start point) (backward-path line feed area). In the description below, the point where the carriage 33 is situated on the rear side in the printing frame 31 is defined as the forward-path start point (backward-path end point). At the forward-path start point, the second moving gear 63 is situated in the toothless area K1 (see FIG. 4) on the rear side of the rack plate 67, and the meshing of the winding rack 87 with the second large gear 77 is released. Also, at the forward-path start point, the carriage 33 is spaced apart to the back at least from the forward-path engaging section 110. Moreover, at the forward-path start point, the engaging protruding section 113 is situated in the forward-path regulating section 122 of the engaging recessed section 115.

Forward-Path Printing Step

As shown in FIGS. 2, 4, and 6, in the forward-path printing step, as the printing motor 91 rotates in the normal direction, its driving force is transmitted to the scanning rack 52 via the scanning gear 92. Then, the carriage 33 moves forward from the forward-path start point. At this point, as shown in FIGS. 4 and 5, since the first large gear 72 is in mesh with the winding rack 87, the first moving gear 62 moves backward relatively to the carriage 33 as the carriage 33 moves forward. Thus, the first small gear 73 of the first moving gear 62 meshes with the intermediate large gear 83, as shown in FIG. 5.

Figure 8:
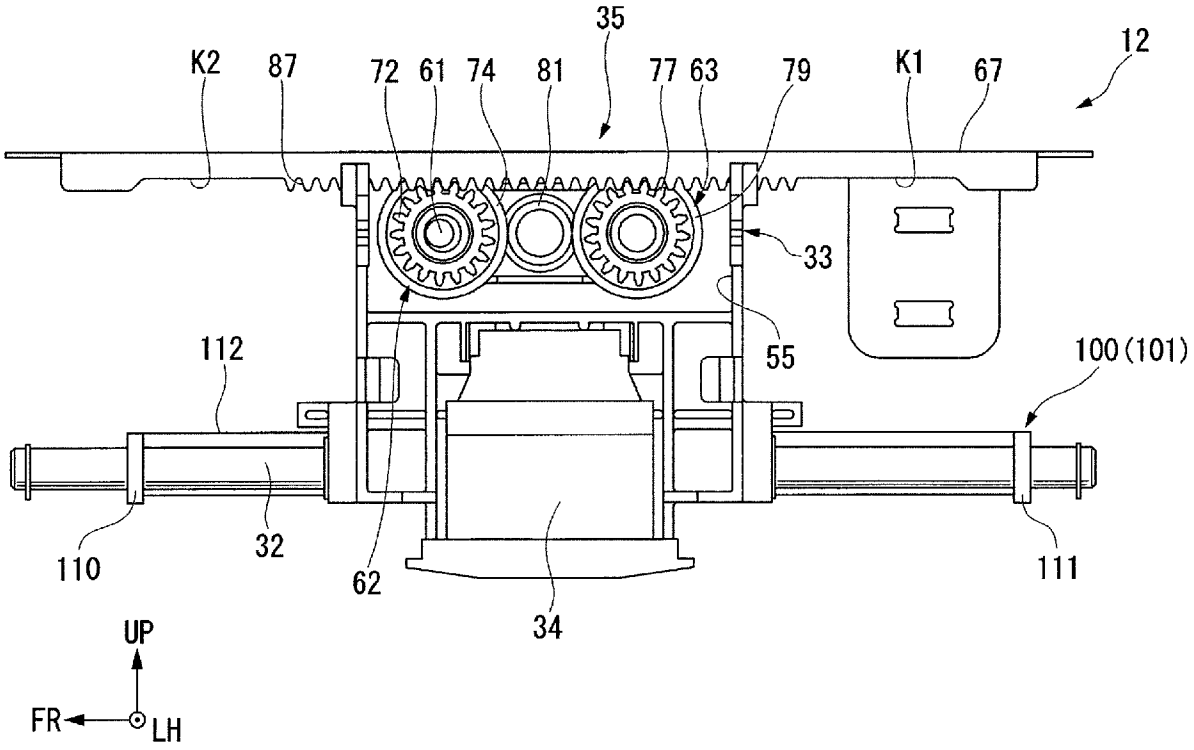
FIG. 8 is an explanatory view for explaining an operation method for the printer according to the first embodiment and is a side view corresponding to FIG. 4.

FIG. 8 is an explanatory view for explaining the operation method for the printer 1 and is a side view corresponding to FIG. 4. In FIG. 8, the cartridge 51, the cover 56 and the like are not shown.

After that, as shown in FIGS. 5 and 8, as the carriage 33 further moves forward, the first moving gear 62 rotates in one direction around the axial line (clockwise in FIG. 8). As the first moving gear 62 rotates in the one direction, the intermediate gear 64 rotates in the opposite direction of the rotation of the first moving gear 62 (in the other direction around the axial line). As the intermediate gear 64 rotates, the reverse gear 65 and the winding shaft 61 rotate in the opposite direction of the rotation of the intermediate gear 64 (in the one direction around the axial line). As the winding shaft 61 rotates, the bobbin of the cartridge 51 rotates. Thus, the carriage 33 moves forward while the ink ribbon of the cartridge 51 is wound up. In the forward-path printing step, when the second moving gear 63 exits the toothless area K1 on the rear side and meshes with the winding rack 87, the second moving gear 63 moves backward relative to the carriage 33. Thus, as shown in FIG. 5, the meshing of the second small gear 78 of the second moving gear 63 with the reverse gear 65 is released. That is, in the forward-path printing step, since the second small gear 78 moves away from the reverse gear 65 in the state where the second large gear 77 is in mesh with the winding rack 87, the second moving gear 63 idles.

As shown in FIG. 2, in the forward-path printing step, as the recording paper P is struck by the head pins of the printing head 34 via the ink ribbon, the printing of the first row is carried out on the recording paper P. Subsequently, as the printing head 34 passes through the printing area of the first row on the recording paper P, the forward-path printing step ends.

Line Feed Step

Figure 9:
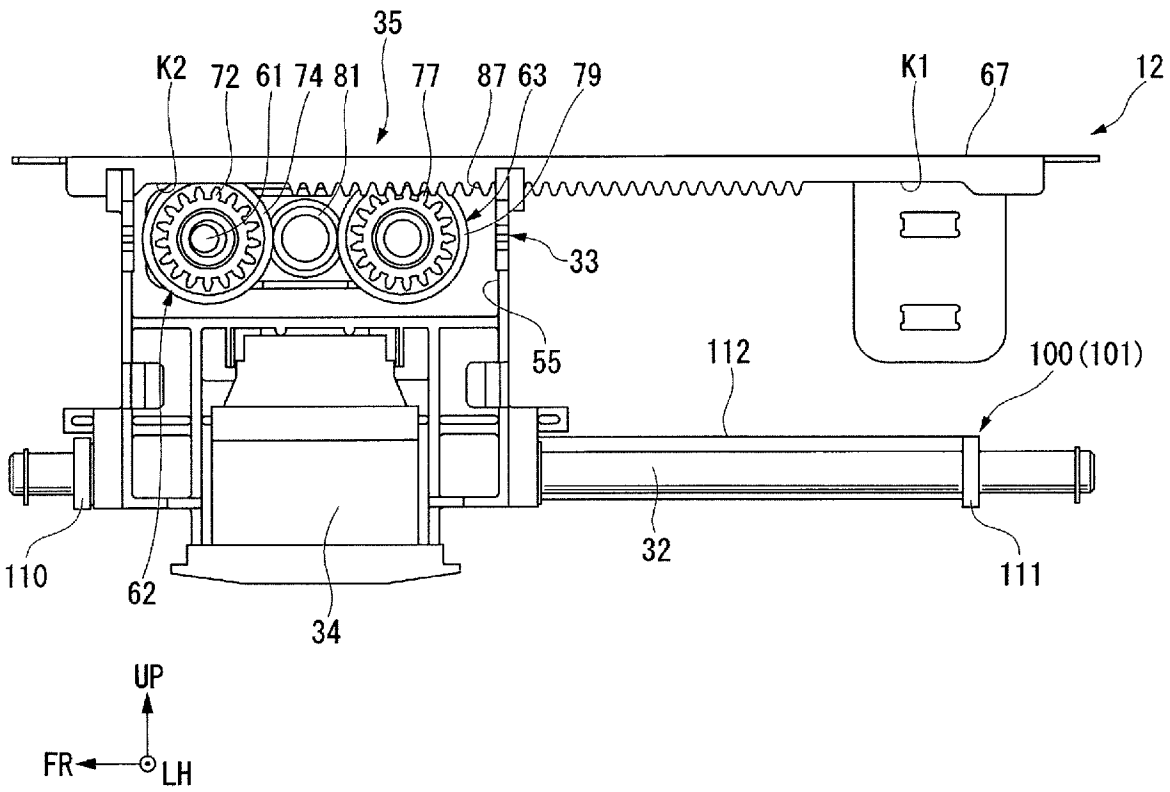
FIG. 9 is an explanatory view for explaining the operation method for the printer according to the first embodiment and is a side view corresponding to FIG. 4.
Figure 10:
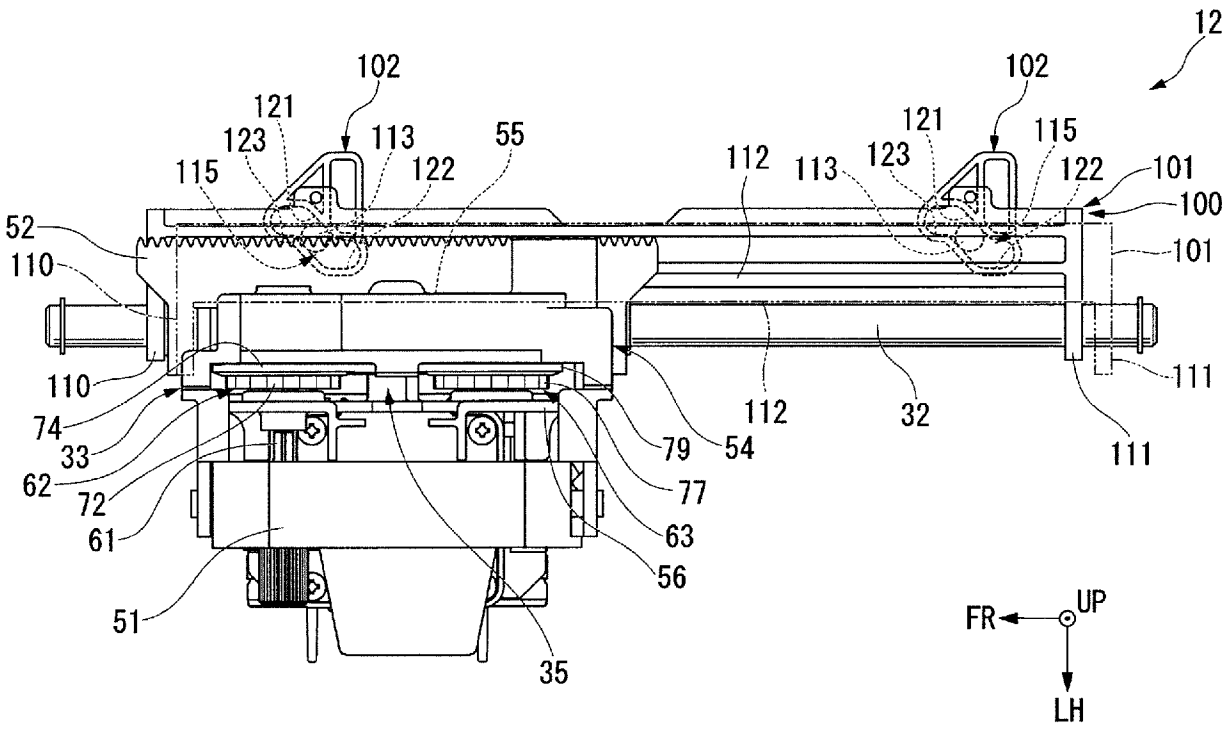
FIG. 10 is an explanatory view for explaining the operation method for the printer according to the first embodiment and is a plan view of the carriage and the line feed mechanism.

FIG. 9 is an explanatory view for explaining the operation method for the printer 1 and is a side view corresponding to the FIG. 4. FIG. 10 is an explanatory view for explaining the operation method for the printer 1 and is a plan view corresponding to FIG. 5.

As shown in FIGS. 9 and 10, in the line feed step, after the printing head 34 passes through the printing area of the first row on the recording paper P, the carriage 33 comes into contact with the forward-path engaging section 110 of the line feed plate 101 from the back. As the carriage 33 further moves forward in this state, the line feed plate 101 moves forward along with the carriage 33. At this point, the line feed plate 101 moves forward relative to the guide members 102, the engaging protruding sections 113 move forward in the forward-path regulating sections 122 of the engaging recessed sections 115. After that, the engaging protruding sections 113 exit the forward-path regulating sections 122 and enter the line feed guides 121 from the back. Then, as the carriage 33 and the line feed plate 101 move forward, the engaging protruding sections 113 move to the right (one side in the column direction) as they move forward (one side in the row direction) in the line feed guides 121. Thus, the entire printing block 12 moves to the right as it moves forward.

Figure 11:
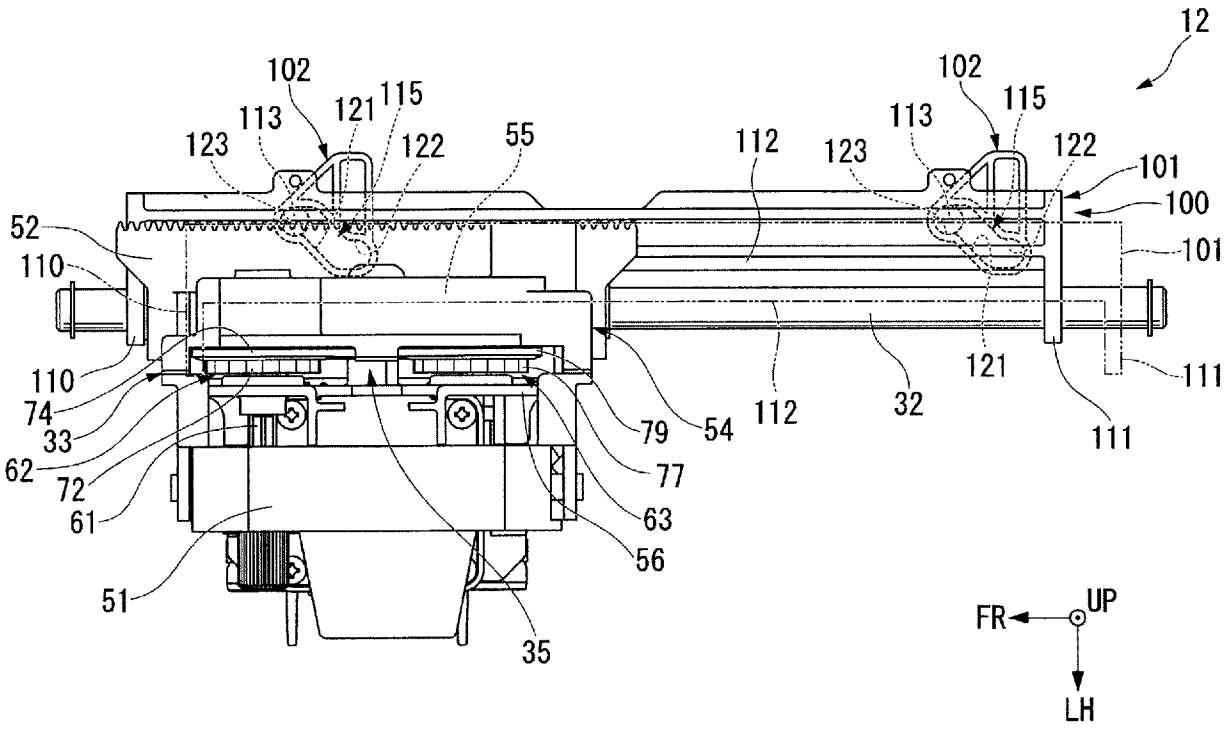
FIG. 11 is an explanatory view for explaining the operation method for the printer according to the first embodiment and is a side view corresponding to FIG. 5.

FIG. 11 is an explanatory view for explaining the operation method for the printer 1 and is a side view corresponding to FIG. 5.

As shown in FIG. 11, when the engaging protruding sections 113 exit the line feed guides 121 in the process of moving forward, the engaging protruding sections 113 enter the backward-path regulating sections 123. After that, as the engaging protruding sections 113 move forward in the backward-path regulating sections 123, the entire printing block 12 moves forward. At the point when the engaging protruding sections 113 approach or come into contact with the front end parts of the backward-path regulating sections 123, the carriage 33 reaches the forward-path start point (backward-path end point). At this point in time, the driving of the printing motor 91 in the normal direction is temporarily stopped. As shown in FIG. 9, after the carriage 33 passes through the printing area of the first row on the recording paper P and before or after the carriage 33 comes into contact with the forward-path engaging section 110, the first moving gear 62 enters the toothless area K2 on the front side, of the rack plate 67. Therefore, before or after the line feed step starts, the first moving gear 62 does not rotate and the ink ribbon is not wound up. The timing when the first moving gear 62 enters the toothless area K2 can be changed as appropriate.

Backward-Path Printing Step

In the backward-path printing step, as the printing motor 91 is rotated in the reverse direction in the state where the carriage 33 is situated at the backward-path start point (forward-path end point), the carriage 33 moves backward. At this point, the carriage 33 moves backward in the portion (backward path) situated to the right of the forward path.

Figure 12:
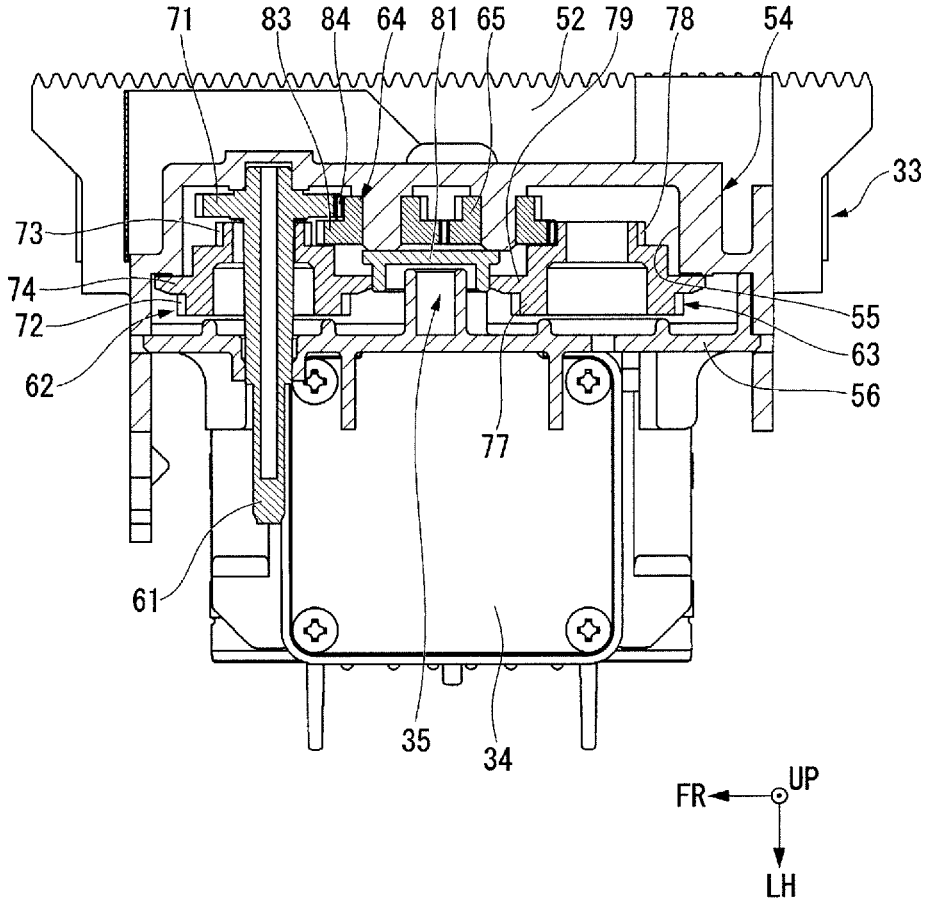
FIG. 12 is an explanatory view for explaining the operation method for the printer according to the first embodiment and is a side view corresponding to FIG. 5.

FIG. 12 is an explanatory view for explaining the operation method for the printer 1 and is a side view corresponding to FIG. 5.

As shown in FIGS. 9 and 12, in the backward-path printing step, since the second large gear 77 is in mesh with the winding rack 87, the second moving gear 63 moves forward relatively to the carriage 33 as the carriage 33 moves backward. Thus, the second small gear 78 of the second moving gear 63 meshes with the reverse gear 65.

As the carriage 33 further moves backward in this state, the second moving gear 63 rotates in the other direction around the axial line. As the second moving gear 63 rotates in the other direction around the axial line (counterclockwise in FIG. 8), the reverse gear 65 rotates in the opposite direction of the rotation of the second moving gear 63 (in the one direction around the axial line). As the reverse gear 65 rotates, the intermediate gear 64 rotates in the opposite direction of the rotation of the reverse gear 65 (in the other direction around the axial line). As the intermediate gear 64 rotates in the other direction around the axial line, the winding shaft 61 rotates in the opposite direction of the rotation of the intermediate gear 64 (in the one direction around the axial line) via the intermediate small gear 84. As the winding shaft 61 rotates in the one direction around the axial line, the bobbin of the cartridge 51 rotates. Thus, as shown in FIG. 8, the carriage 33 moves backward while the ink ribbon of the cartridge 51 is wound up. That is, in the embodiment, since the winding shaft 61 rotates in the one direction both in the forward-path printing step and in the backward-path printing step, the ink ribbon is wound in the same direction.

In the backward-path printing step, when the first moving gear 62 exits the toothless area K2 on the front side and meshes with the winding rack 87, the first moving gear 62 moves forward relative to the carriage 33. Thus, the meshing of the first small gear 73 of the first moving gear 62 with the reverse gear 65 is released. That is, in the backward-path printing step, as the first small gear 73 moves away from the reverse gear 65 in the state where the first large gear 72 is in mesh with the winding rack 87, the first moving gear 62 idles.

Then, in the backward-path printing step, as the recording paper P is struck by the head pins of the printing head 34 via the ink ribbon, printing of the second row is performed on the recording paper P. After that, as the printing head 34 passes through the printing area of the second row on the recording paper P, the backward-path printing step ends.

Carriage Return Step

As shown in FIGS. 4 and 6, in the carriage return step, after the printing head 34 passes through the printing area of the second row on the recording paper P, the carriage 33 comes into contact with the backward-path engaging section 111 of the line feed plate 101 from the front. As the carriage 33 further moves backward in this state, the line feed plate 101 moves backward along with the carriage 33. At this point, as the line feed plate 101 moves backward relative to the guide members 102, the engaging protruding sections 113 move backward in the backward-path regulating sections 123 of the engaging recessed sections 115. After that, the engaging protruding sections 113 exit the backward-path regulating sections 123 and enter the line feed guides 121 from the front. Then, as the carriage 33 and the line feed plate 101 move backward, the engaging protruding sections 113 move to the left (one side in the column direction) as they move backward (one side in the row direction) in the line feed guides 121. Thus, the entire printing block 12 moves to the left as it goes backward.

Then, in the process of moving backward, the engaging protruding sections 113 exit the line feed guides 121 to the back side and then enter the forward-path regulating sections 122. After that, as the engaging protruding sections 113 move backward in the forward-path regulating sections 122, the entire printing block 12 moves backward. Then, at the point when the engaging protruding sections 113 approach or come into contact with the rear end parts of the forward-path regulating sections 122, the carriage 33 reaches the backward-path end point (forward-path start point). At this point in time, the driving of the printing motor 91 in the reverse direction is stopped. After the carriage 33 passes through the printing area of the second row on the recording paper P and before or after the carriage 33 comes into contact with the backward-path engaging section 111, the second moving gear 63 enters the toothless area K1 on the rear side, of the rack plate 67. Therefore, before or after the carriage return step starts, the second moving gear 63 does not rotate and the ink ribbon is not wound up. That is, in the printing block 12 in the embodiment, the area where both of the moving gears 62 and 63 are in mesh with the winding rack 87 is set as the printing operation area. Meanwhile, the area where one of the moving gears 62 and 63 is situated in the toothless area K1 or K2 is set as the line feed area. However, the timing when the second moving gear 63 enters the toothless area K1 can be changed as appropriate.

As shown in FIG. 2, when the carriage 33 returns to the forward-path start point, the platen motor 24 is actuated. Then, since the driving force of the platen motor 24 is transmitted to the platen main body 22 via the platen wheel train 25, the platen main body 22 moves down. Thus, the holding of the recording paper P by the frame base 15 and the platen main body 22 is released. After that, when the recording paper P is removed from the slot 5, the printing operation ends.

Incidentally, in the printer 1 in the embodiment, a driving substrate (not illustrated) is arranged above the printing block 12. Wires drawn out of the driving substrate are connected to the printing motor 91 shown in FIG. 2 and various sensors (for example, a position sensor 68) through the right side of the printing block 12. In this case, in a low-temperature environment or the like, if the tube covering the wires hardens, for example, an external force which causes the printing block 12 to move to the left acts on the printing block 12. Also, if other external forces act in the left-right direction of the printer 1, the printing block 12 is led to move in the left-right direction.

Here, in this embodiment, the engaging protruding sections 113 stay in the forward-path regulating sections 122 until at least the carriage 33 reaches the forward-path line feed area via the printing operation area from the forward-path start point. Therefore, if an external force which causes the printing block 12 to move in the left-right direction acts and the engaging protruding sections 113 are thus led to move in the left-right direction relatively to the guide members 102, the engaging protruding sections 113 come into contact with the inner surfaces of the forward-path regulating sections 122 in the left-right direction. Thus, further movement of the engaging protruding sections 113 in the left-right direction relative to the guide members 102 is regulated.

Also, the engaging protruding sections 113 stay in the backward-path regulating sections 123 until at least the carriage 33 reaches the backward-path line feed area via the printing operation area from the backward-path start point. Therefore, if an external force which causes the printing block 12 to move in the left-right direction acts and the engaging protruding sections 113 are thus led to move in the left-right direction relatively to the guide members 102, the engaging protruding sections 113 come into contact with the inner surfaces of the backward-path regulating sections 123 in the left-right direction. Thus, further movement of the engaging protruding sections 113 in the left-right direction relative to the guide members 102 is regulated.

In this way, in the embodiment, the line feed mechanism 100 includes the line feed plate 101, which moves along with the carriage 33 in the line feed operation area situated outside the printing operation area, and the guide members 102, which engage with the line feed plate 101 and guide the printing block 12 in the left-right direction as the printing block 12 moves in the front-back direction.

With this configuration, since the carriage 33 moves in the left-right direction as the carriage 33 moves in the front-back direction along with the line feed plate 101 in the line feed operation area, the carriage 33 moves through different positions in the left-right direction in the printing operation areas on the forward path and the backward path. In this case, for example, if printing with the printing head 34 is performed both on the forward path and on the backward path, printing can be performed in two different columns of printing areas in the left-right direction on the recording paper P. Consequently, the volume of information that can be printed at a time can be increased and marketability can be improved.

Particularly, in the embodiment, the regulating sections 122 and 123 continuing to the line feed guides 121 in the front-back direction and regulating the movement of the carriage 33 in the left-right direction are provided.

With this configuration, even if an external force in the left-right direction acts on the printing block 12, the movement of the line feed plate 101 in the left-right direction relative to the guide members 102 is regulated, as described above. Therefore, the printing block 12 can be restrained from moving unexpectedly in the left-right direction. In this case, inconveniences such as an overlap between forward-path information (information printed in the first row) and backward-path information (information printed in the second row), or forward-path information and backward-path information being too distant from each other in the left-right direction, can be restrained. Therefore, the marketability of the printing unit 3 can be improved.

Moreover, in the embodiment, the movement of the engaging protruding sections 113 in the left-right direction can be regulated at the position that does not enter the moving trajectory of the engaging protruding sections 113 in the engaging recessed sections 115. Therefore, the load applied to the printing motor 91 in the line feed step can be reduced, for example, compared with the case where protrusions or the like which the engaging protruding sections 113 can climb over are provided in the moving trajectory of the engaging protruding sections 113 (for example, the bottom surfaces or inner surfaces of the engaging recessed sections 115). Thus, an increase in size of the printing motor 91 can be restrained and energy saving can be realized.

In the embodiment, the regulating sections 122 and 123 continue to the front and rear end parts of the line feed guides 121. Therefore, the printing block 12 can be restrained from unexpectedly moving in the left-right direction in the printing operation area both on the forward path and on the backward path. Thus, further improvement in marketability can be achieved.

In the embodiment, the regulating sections 122 and 123 extend linearly in the front-back direction. Therefore, when the printing block 12 is led to move unexpectedly in the left-right direction due to an external force, the amount of movement of the printing block 12 in the left-right direction can be minimized.

In the embodiment, since the line feed guides 121 and the regulating sections 122 and 123 are formed in the groove-like engaging recessed sections 115, the engaging protruding sections 113 can be guided smoothly. Also, since the engaging protruding sections 113 are surrounded from both sides in the left-right direction, the movement of the engaging protruding sections 113 to both the sides in the left-right direction relative to the guide members 102 can be regulated when the an external force acts on the printing block 12.

The line feed plate 101 in the embodiment includes the forward-path engaging section 110, with which the carriage 33 engages in the forward-path line feed area, and the backward-path engaging section 111, with which the carriage 33 engages in the backward-path line feed area.

With this configuration, the carriage 33 engages with the forward-path engaging section 110 of the line feed plate 101 while moving through the forward path. Therefore, when subsequently heading toward the forward-path end point, the carriage 33 moves to the right along with the line feed plate 101. Also, the carriage 33 engages with the backward-path engaging section 111 of the line feed plate 101 while moving through the backward path. Therefore, when subsequently heading toward the backward-path end point, the carriage 33 moves to the left along with the line feed plate 101. Thus, in the line feed operation area, the printing block 12 can be smoothly moved for line feed.

Moreover, in the embodiment, swings of the printing frame 31 around the shaft 32 is regulated in the state where the bearing sections 46 are supporting the shaft 32 in such a way that the shaft 32 can move in the left-right direction. Therefore, a reduction in the number of components, a reduction in cost, and improvement in assemblability can be achieved, compared with the case where the respective functions are performed by separate components.

In the embodiment, the ink ribbon is wound up as the carriage 33 moves. Therefore, the occurrence of changes in print density, print blurs and the like can be restrained, and good printing quality can be maintained.

In the embodiment, the toothless areas K1 and K2 for releasing the meshing between the large gears 72 and 77 on the winding side (the side where the winding shaft 61 is rotated) of the moving gears 62 and 63, and the winding rack 87, in the line feed step and the carriage return step of the carriage 33, are formed in the rack plate 67.

With this configuration, when the carriage 33 passes by both ends in the front-back direction of the rack plate 67, the moving gears 62 and 63 on the winding side do not rotate with the movement of the carriage 33. That is, while the carriage 33 moves through the toothless areas K1 and K2 (line feed operation area), the ink ribbon is not wound up. Therefore, the load torque required for the winding in the line feed step and the carriage return step is restrained from acting on the printing motor 91, and the line feed operation can be performed smoothly. Also, since the unwanted winding of the ink ribbon can be restrained in the line feed step and the carriage return step, the ink ribbon can be effectively used.

Since the printer 1 in the embodiment includes the foregoing printing unit 3, the marketability of the printer 1 can be improved.

Second Embodiment

Figure 13:
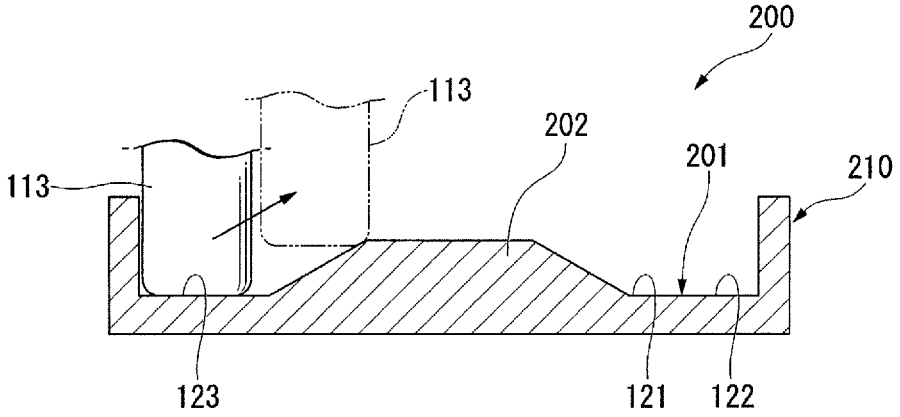
FIG. 13 is a cross-sectional view corresponding to a line XIII-XIII in FIG. 7, in a line feed mechanism according to a second embodiment.

FIG. 13 is a cross-sectional view corresponding to a line XIII-XIII in FIG. 7 in a line feed mechanism 200 according to a second embodiment. This embodiment is different from the foregoing embodiment in that step sections 202 which the engaging protruding sections 113 can climb over are formed on the moving trajectory of the engaging protruding sections 113 in engaging recessed sections 201. In the description below, configurations similar to those of the first embodiment are denoted by the same reference numbers and not described further in detail.

In the line feed mechanism 200 shown in FIG. 13, the step section 202 at which the engaging protruding section 113 is caught is formed in the line feed guide 121 of a guide member 210 (engaging recessed section 201). Specifically, the step section 202 protrudes upward from the bottom surface of the line feed guide 121. The cross section of the step section 202 along its extending direction is formed in a trapezoidal shape. Specifically, both ends of the step section 202 in the extending direction have sloped surfaces extending upward as they head toward the center. The center part in the extending direction of the step section 202 has a flat surface.

With this configuration, even if an external force acts on the printing block 12 and therefore the engaging protruding section 113 exits the regulating sections 122 and 123 and enters the line feed guide 121, the movement of the engaging protruding section 113 toward the center part in the extending direction within the line feed guide 121 is regulated by the step section 202. Thus, when an external force acts on the printing block 12, the printing block 12 can be restrained from unexpectedly moving between the forward path and the backward path. In the line feed step and the carriage return step, as the line feed plate 101 moves in the front-back direction along with the carriage 33 in the state where the carriage 33 is engaged with the forward-path engaging section 110 or the backward-path engaging section 111, the engaging protruding section 113 climbs over the step section 202. Thus, the line feed step and the carriage return step are carried out with effects similar to those in the foregoing embodiment.

In the embodiment described above, the step section 202 is provided on the bottom surface of the line feed guide 121. However, this configuration is not limiting. The step section 202 may be provided on the inner surface of the line feed guide 121.

Also, the step section 202 may be provided at least at a part of the bottom surface or the inner surface of the engaging recessed section 201. In this case, the step section may be provided in the regulating sections 122 and 123. Thus, the engaging protruding section 113 can be restrained from entering the line feed guide 121 from the regulating sections 122 and 123.

Modifications

Figure 14:
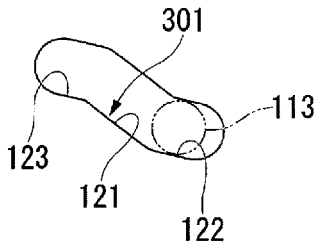
FIG. 14 is a plan view of an engaging recessed section according to a modification.
Figure 15:
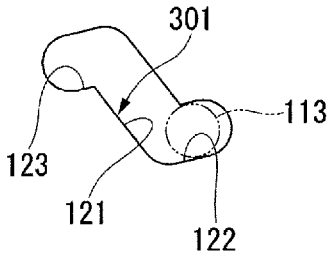
FIG. 15 is a plan view of an engaging recessed section according to a modification.
Figure 16:
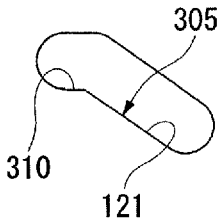
FIG. 16 is a plan view of an engaging recessed section according to a modification.

Next, modifications of the embodiments will be described. FIGS. 14 to 16 are plan views showing engaging recessed sections 301 according to the modifications.

In the description of the embodiments, the regulating sections 122 and 123 are linearly formed long the front-back direction. However, this configuration is not limiting. For example, the regulating sections 122 and 123 may extend while slightly tilted (at an angle of elevation) to the outer side in the left-right direction as they head toward the outer side in the front-back direction, as shown in FIG. 14. Also, the regulating sections 122 and 123 may be slightly tilted to the inner side in the left-right direction as they head toward the outer side in the front-back direction, as shown in FIG. 15. In this way, it suffices that the regulating sections 122 and 123 extend along the front-back direction and can regulate the movement of the engaging protruding sections 113 in the left-right direction so that the engaging protruding sections 113 do not enter the printing operation areas on the forward path and the backward path. That is, it suffices that the regulating sections 122 and 123 extend at a different tilt angle from that of the line feed guide 121.

In the description of the embodiments, the regulating sections continue to both ends in the front-back direction of the line feed guides 121. However, this configuration is not limiting. As an engaging protruding section 305 shown in FIG. 16, a regulating section 310 may continue to at least one end part in the front-back direction of the line feed guide 121. With this configuration, the printing block 12 can be restrained from unexpectedly moving in the left-right direction in the printing operation area on one of the forward path and the backward path.

The technical scope of the invention is not limited to the embodiments. Various changes can be added to the technical scope without departing from the spirit of the invention.

For example, in the embodiments, the printer 1 of the invention is applied to the printer 1 of the dot impact type. However, the invention is not limited to this example. For example, the printer 1 may be applied, for example, to an inkjet printer or a thermal printer. The use of the printer 1 is not limited to timestamps.

In the description of the embodiments, the printing is performed both on the forward path and on the backward path. However, the printing may be performed on at least one of the forward path and the backward path (for example, printing of the first row only or printing of the second row only).

In the description of the embodiments, the engaging protruding sections 113 are formed in the line feed plate 101, and the engaging recessed sections are formed in the guide members 102. However, conversely, the engaging recessed sections may be formed in the line feed plate (first member) 101, and the engaging protruding sections may be formed in the guide members (second member) 102.

In the description of the embodiments, the engaging recessed sections are formed in the shape of grooves. However, this configuration is not limiting. Walls or the like extending along the moving trajectory of the engaging protruding sections 113 may be employed, provided that such walls can guide the movement of the engaging protruding sections 113.

The engaging method for the line feed plate and the guide members can be changed as appropriate. For example, the line feed plate and the guide members may be engaged with each other by a worm gear mechanism or a link mechanism.

In the description of the embodiments, the step section 202, which the engaging protruding section 113 can climb over, regulates unexpected movement of the engaging protruding section 113. However, this configuration is not limiting. For example, the printing block 12 may be energized toward the outer side in the left-right direction (in the direction away from the printing operation areas on the forward path and the backward path) by an energizing member or the like.

In the description of the embodiments, two engaging protruding sections 113 and two engaging recessed sections are provided. However, this is not limiting and the number of these sections may be one, or three or more. If there is one engaging protruding section 113 and one engaging recessed section, a rail or the like which guides the movement of the printing block 12 in the left-right direction may be provided separately.

The timing of engagement and the engaging method for the carriage 33 and the engaging sections 110 and 111 can be changed in design as appropriate.

The toothless areas K1 and K2 of the rack plate 67 may be absent.

In the description of the embodiments, the printing is performed in two different rows in the left-right direction. However, the configuration of the invention may be employed for a printer which performs printing of three or more rows.

Moreover, the components in the embodiments described above can be replaced with known components as appropriate without departing from the spirit of the invention. The modifications may be combined as appropriate.

What is claimed is:

1. A printing unit comprising:

a carriage equipped with a printing head that performs printing on a recording medium in a printing operation area extending in a row direction;

a shaft that supports the carriage, such that the carriage can reciprocate in the row direction;

a unit frame that supports the shaft, such that the shaft can move in a column direction orthogonal to the row direction;

an interlocking member that moves with the carriage in a line feed operation area outside the printing operation area in the row direction; and a guide member on the unit frame that engages with the interlocking member and guides the carriage and the interlocking member toward one side in the column direction with movement of the carriage and the interlocking member toward one side in the row direction in the line feed operation area, wherein a first member is one of the interlocking member and the guide member and includes:

a line feed guide that extends toward one side in the column direction as it extends toward one side in the row direction and that guides the carriage toward one side in the column direction with the movement of the carriage toward one side in the row direction in the line feed operation area; and a regulating section integral with the line feed guide and that continues at least to one end part in the row direction of the line feed guide and regulates the movement of the carriage in the column direction.

2. The printing unit according to claim 1, wherein the regulating section continues to both end parts in the row direction of the line feed guide.

3. The printing unit according to claim 1, wherein the regulating section linearly extends along the row direction.

4. The printing unit according to claim 1, wherein the printing unit further comprises an engaging protruding section protruding toward the first member on a second member being the other of the interlocking member and the guide member, an engaging recessed section that engages with the engaging protruding section is on the first member, and wherein the engaging recessed section has the line feed guide and the regulating section.

5. The printing unit according to claim 1, wherein the interlocking member is supported by the shaft so as to move in the row direction, the interlocking member further includes:

a forward-path engaging section with which the carriage engages in a forward-path line feed area continuing to one side of the printing operation area, of the line feed operation area; and a backward-path engaging section with which the carriage engages in a backward-path line feed area continuing to the other side of the printing operation area of the line feed operation area.

6. The printing unit according to claim 1, further comprising:

a driving source that moves the carriage in the row direction;

a printing frame equipped with the driving source and supporting the shaft; and a bearing section in the unit frame that supports the shaft such that the shaft can reciprocate in the column direction, and that is coupled to the printing frame to regulate a swing of the printing frame around the shaft.

7. The printing unit according to claim 1, wherein the printing head is an impact type, and the printing unit further comprises a winding mechanism that is connected to a cartridge removably loaded in the carriage and winds an ink ribbon in the cartridge, wherein the winding mechanism includes:

a winding gear in the carriage; and a rack plate including a winding rack that meshes with the winding gear, and the winding mechanism winds the ink ribbon, and the winding gear rotate as the carriage moves in the row direction.

8. The printing unit according to claim 7, wherein the rack plate further includes toothless areas that release the meshing of the winding gear with the winding rack at both end parts in the row direction.

9. A printer comprising:

the printing unit according to claim 1; and a casing that houses the printing unit and has a slot into which a recording medium is inserted.

10. A printing unit comprising:

a carriage equipped with a printing head that performs printing on a recording medium in a printing operation area extending in a row direction;

a shaft that supports the carriage, such that the carriage can reciprocate in the row direction;

a unit frame that supports the shaft, such that the shaft can move in a column direction orthogonal to the row direction;

an interlocking member that moves with the carriage in a line feed operation area outside the printing operation area in the row direction; and a guide member on the unit frame that engages with the interlocking member and guides the carriage and the interlocking member toward one side in the column direction with movement of the carriage and the interlocking member toward one side in the row direction in the line feed operation area, wherein a first member is one of the interlocking member and the guide member and includes:

a line feed guide that extends toward one side in the column direction as it extends toward one side in the row direction and that guides the carriage toward one side in the column direction with the movement of the carriage toward one side in the row direction in the line feed operation area; and a regulating section that continues at least to one end part in the row direction of the line feed guide and regulates the movement of the carriage in the column direction, wherein a step section that the first member can climb over resides in at least one of the line feed guide and the regulating section.

* * * * *